US007263307B2

(12) United States Patent
Furumoto

(10) Patent No.: US 7,263,307 B2
(45) Date of Patent: Aug. 28, 2007

(54) MODE INDICATION DEVICE FOR AN IMAGE FORMING DEVICE

(75) Inventor: Takayuki Furumoto, Shiojiri (JP)

(73) Assignee: Kyocera Mita Corporation, Osaka (JP)

( * ) Notice: Subject to any disclaimer, the term of this patent is extended or adjusted under 35 U.S.C. 154(b) by 0 days.

(21) Appl. No.: 11/258,924

(22) Filed: Oct. 27, 2005

(65) Prior Publication Data

US 2007/0098428 A1 May 3, 2007

(51) Int. Cl.
*G03G 15/00* (2006.01)

(52) U.S. Cl. ..... 399/81; 399/82; 399/83; 399/85

(58) Field of Classification Search ..... 399/81
See application file for complete search history.

(56) References Cited

U.S. PATENT DOCUMENTS 5,049,929 A * 9/1991 Anderson et al. ..... 399/82
5,159,546 A * 10/1992 Inoue et al. ..... 399/81
6,233,414 B1 * 5/2001 Farrell ..... 399/81
6,239,880 B1 * 5/2001 Barrett et al. ..... 399/82
6,516,178 B2 * 2/2003 Fukushima ..... 399/81
6,618,170 B1 * 9/2003 Whiting et al. ..... 399/81

* cited by examiner

*Primary Examiner*—David M. Gray
*Assistant Examiner*—Ruth N LaBombard
(74) *Attorney, Agent, or Firm*—Global IP Counselors, LLP

(57) ABSTRACT

An image forming device has a setting means for setting the copy mode for a document, a detection means for detecting whether or not a document has been placed on a document holder, an assessment means for assessing, when it is detected that a document has been placed on the document holder, whether or not the set copy mode is identical to the default mode, and a warning means for issuing a warning if the assessed mode is not the default. If the set copy mode is not identical to the default mode, by issuing a warning without automatically reverting to the default mode, the copy mode does not revert to the initial state against the user's intent.

14 Claims, 6 Drawing Sheets

MODE INDICATION DEVICE FOR AN IMAGE FORMING DEVICE

FIELD OF THE INVENTION

The present invention relates to an image forming device such as a copier and a multi-function machine.

BACKGROUND INFORMATION

An image forming device can copy in a variety of copy modes, such as expand, reduce and black and white inversion, in response to a user request. As the copy mode requested of the image forming device differs from user to user or from job to job, the image forming device comprises an auto-clear function, which reverts the copy mode to the default mode, when a given time elapses after copying.

However, if an auto-clear function is provided, as the user tends to realize that the copy mode is always in the default mode, sometimes the user copies without verifying the copy mode that has been set, thinking that the currently set copy mode is the default mode. Therefore, if the next copy is made before the copy mode is reverted to the default mode by the auto-clear function, the copy is made in the same mode as the preceding job.

A technique to solve such issues is known, wherein a carpet reset switch is laid on the floor in front of the image forming device, at a position where the user stands when copying with the image forming device, and if the carpet reset switch is stepped onto, the copy mode is automatically reverted to the default mode.

However, if an image forming device comprises a carpet reset switch, the mechanisms of the image forming device become complex and the manufacturing costs become high.

In addition, since the default mode is invoked each time the carpet reset switch is stepped onto, for instance, if the foot is removed from the carpet reset switch to go and fetch a document after setting the copy mode, the copy mode must be set again, as the set copy mode returns to the default mode.

In addition, when executing a plurality of jobs with the same copy mode, the copy mode returns to the default mode should the foot be removed from the carpet reset switch during the execution of the plurality of jobs; thus, if the foot is removed from the carpet reset switch during the execution of a plurality of jobs, the copy mode must be set again when executing the next job.

Therefore, an object of the present invention is to provide an image forming device wherein the copy mode returns to the default mode only with the user's intention, without making the mechanism complex and while keeping the manufacturing costs down.

SUMMARY OF THE INVENTION

The image forming device of the present invention comprises a setting means for setting a copy mode for a document, a detection means for detecting whether or not a document has been placed on a document holder, an assessment means for assessing, when it is detected that a document has been placed on the document holder, whether or not the set copy mode is identical to the default mode, and a warning means for issuing a warning if the assessed mode is not the default mode.

In this way, the image forming device of the present invention only issues a warning when the copy mode is not in the default mode, and does not automatically revert the copy mode to the default mode.

As described in the foregoing, when it is detected that a document has been placed on the document holder, assessment is made of whether or not the copy mode is in the default mode, and if different from the default mode, the copy mode is not reverted to the default mode; instead, a warning is issued, which allows the user to recognize that the set copy mode is not the default mode when a document is placed on the document holder. Thus, it is possible to prevent the copy mode from returning to the default mode, and thus to prevent copying in the default mode, against the user's intention.

DETAILED DESCRIPTION OF THE PREFERRED EMBODIMENTS

Embodiment 1

Figure 1:
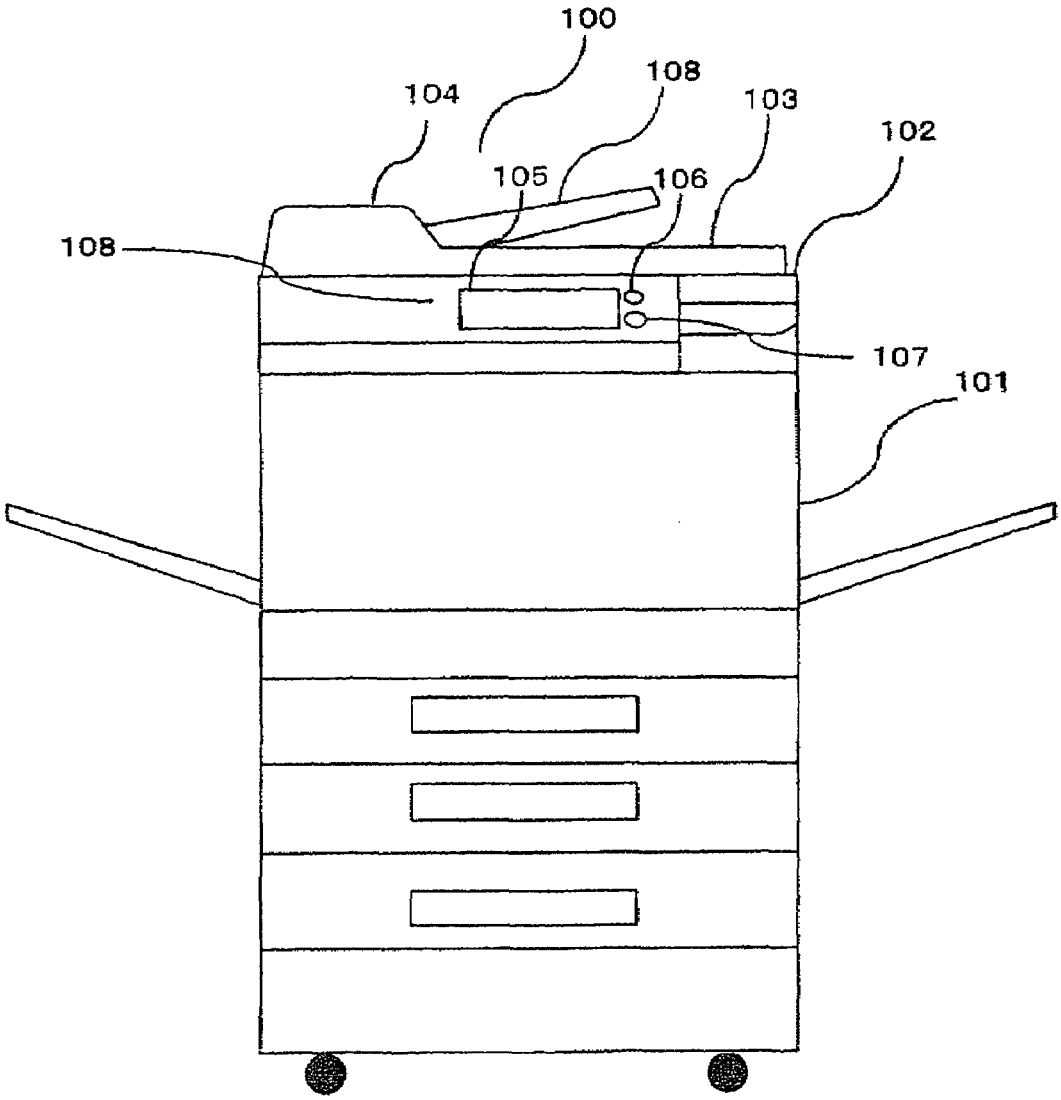
FIG. 1 is a schematic external view of the image forming device of the present invention.

A schematic external view of an image forming device 100 of the embodiment is shown in FIG. 1. As shown in FIG. 1, the image forming device 100 is capable of reading and copying a document placed on a glass document holder 102 provided on the upper surface of a main body 101, or on a document holder 108 of an ADF 104 mounted on a platen cover 103.

Figure 2:
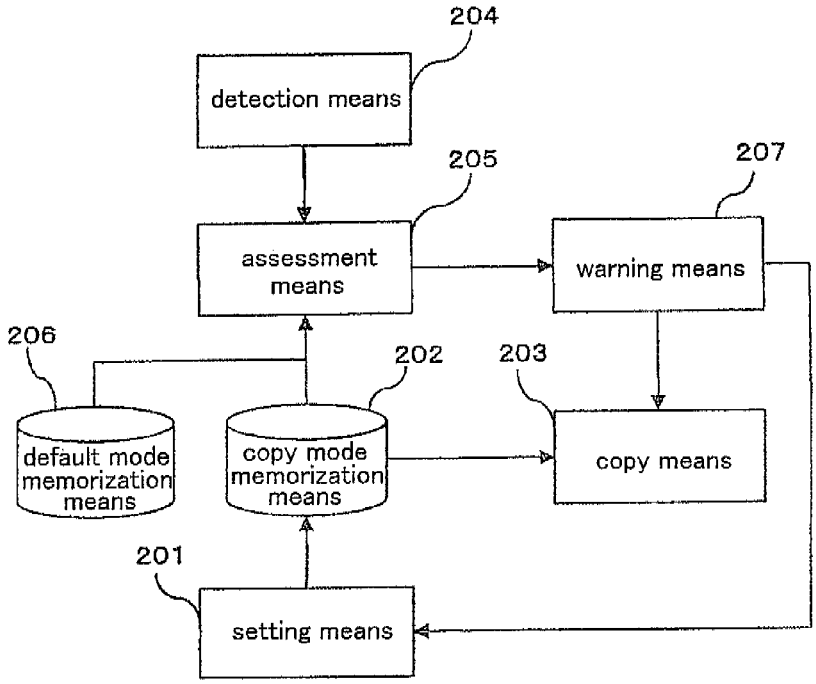
FIG. 2 is a functional block diagram of the image forming device of the present invention.

Similarly to the image forming devices described in the background art, the image forming device 100 can print in a variety of copy modes, such as expand, reduce and black and white inversion, according to a user's request. Specification of the copy mode to the image forming device 100 is performed using an operation unit 108 constituted by a control panel 105 (FIG. 7), a reset key 106, a start key 107 and the like, which are hard keys, provided on the image forming device 100. The copy mode specified using the operation unit 108 is stored in a copy mode memorization means 202 at a setting means 201 shown in FIG. 2.

The document placed in the document holder 102 or the document holder 108 is read, and copying is performed by a copy means 203 in the copy mode stored in the copy mode memorization means 202.

The document holder 108 of the ADF 104 comprises a switch that contacts with the placed document, or a transmissive light sensor that detects whether light is blocked by the placed document. The image forming device 100 comprises a detection means 204 that detects whether or not a document has been placed on the document holder 108 based on the output of the switch and sensor.

Figure 3:
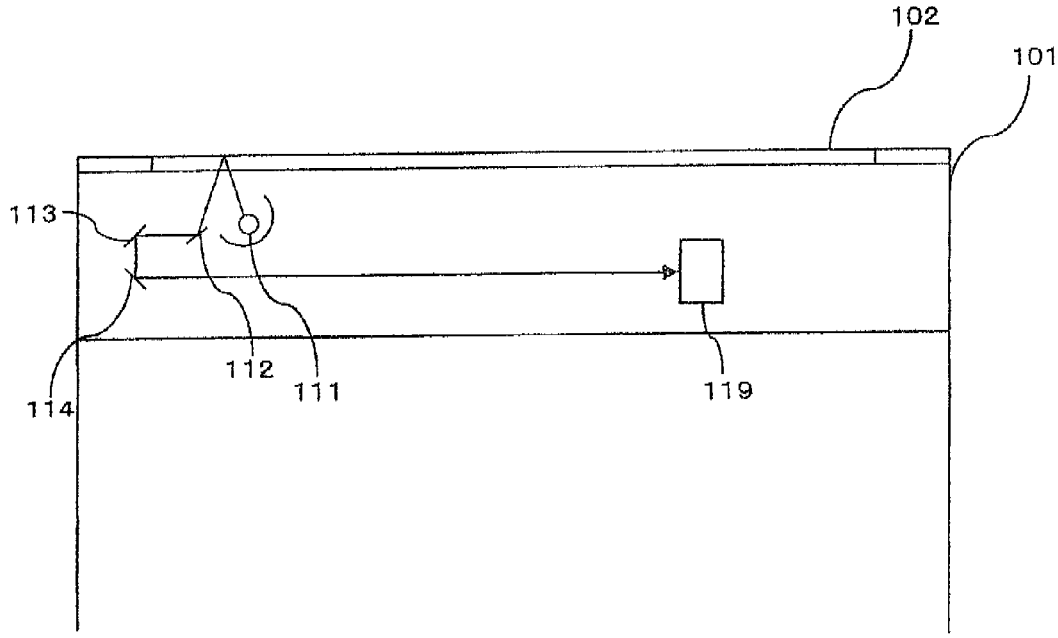
FIG. 3 is an expanded view in the periphery of the document holder of the main body of the image forming device of the present invention.

In addition, it comprises underneath the document holder 102, an exposure lamp 111 that illuminates the document holder 102, a mirror 112, a mirror 113 and a mirror 114 that reflect the incident light from a predetermined main scanning line of the document holder 102, and a CCD 119 that receives the light reflected at the mirror 114, as shown in FIG. 3.

When the platen cover 103 is folded down to a certain angle, the exposure lamp 111 is ignited, illuminating the document holder 102, and detection of the size of the document placed on the document holder 102 is carried out. If the document size is detected, the detection means 204 recognizes that a document is placed on the document holder 102.

As described above, the detection means 204 detects that a document has been placed on the document holder 108 of the ADF 104, and that a document has been placed on the document holder 102.

When the user places a document on the document holder 108 or closes the platen cover 103, the detection means 204 detects whether a document has been placed from the output of the switch or sensor the document holder 108 is provided with, or from the result of the document size detection. If it is detected that a document is placed, the detection means 204 reports to an assessment means 205 the fact that a document is placed (FIG. 4, S401).

Figure 4:
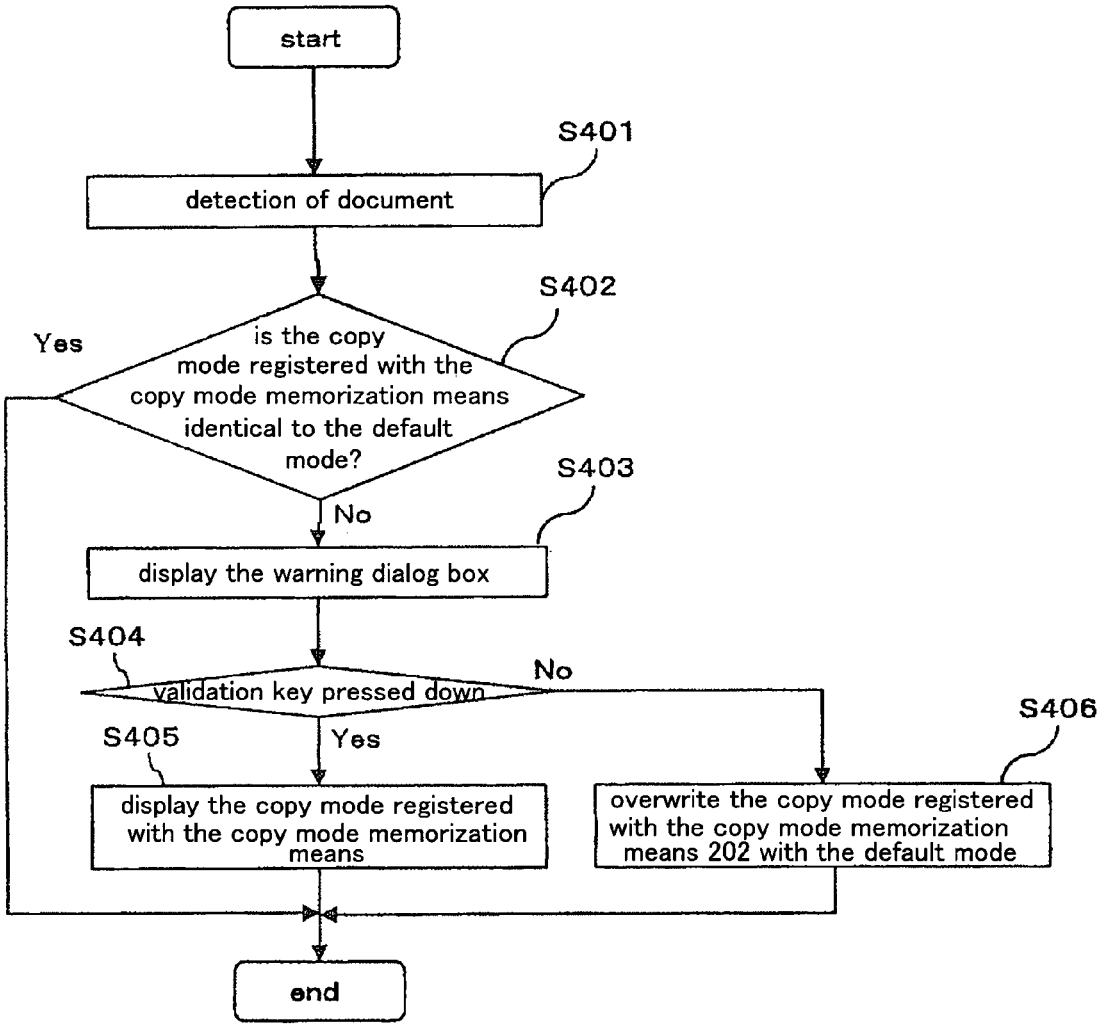
FIG. 4 is a flowchart showing the procedures until a warning is displayed.

When the fact that a document is placed is reported, the assessment means 205 assesses whether or not the copy mode registered with the copy mode memorization means 202 is identical to the default mode for the copy mode (FIG. 4, S402). The default mode for the copy mode is memorized in a default mode memorization means 206 shown in FIG. 2.

Figure 5:
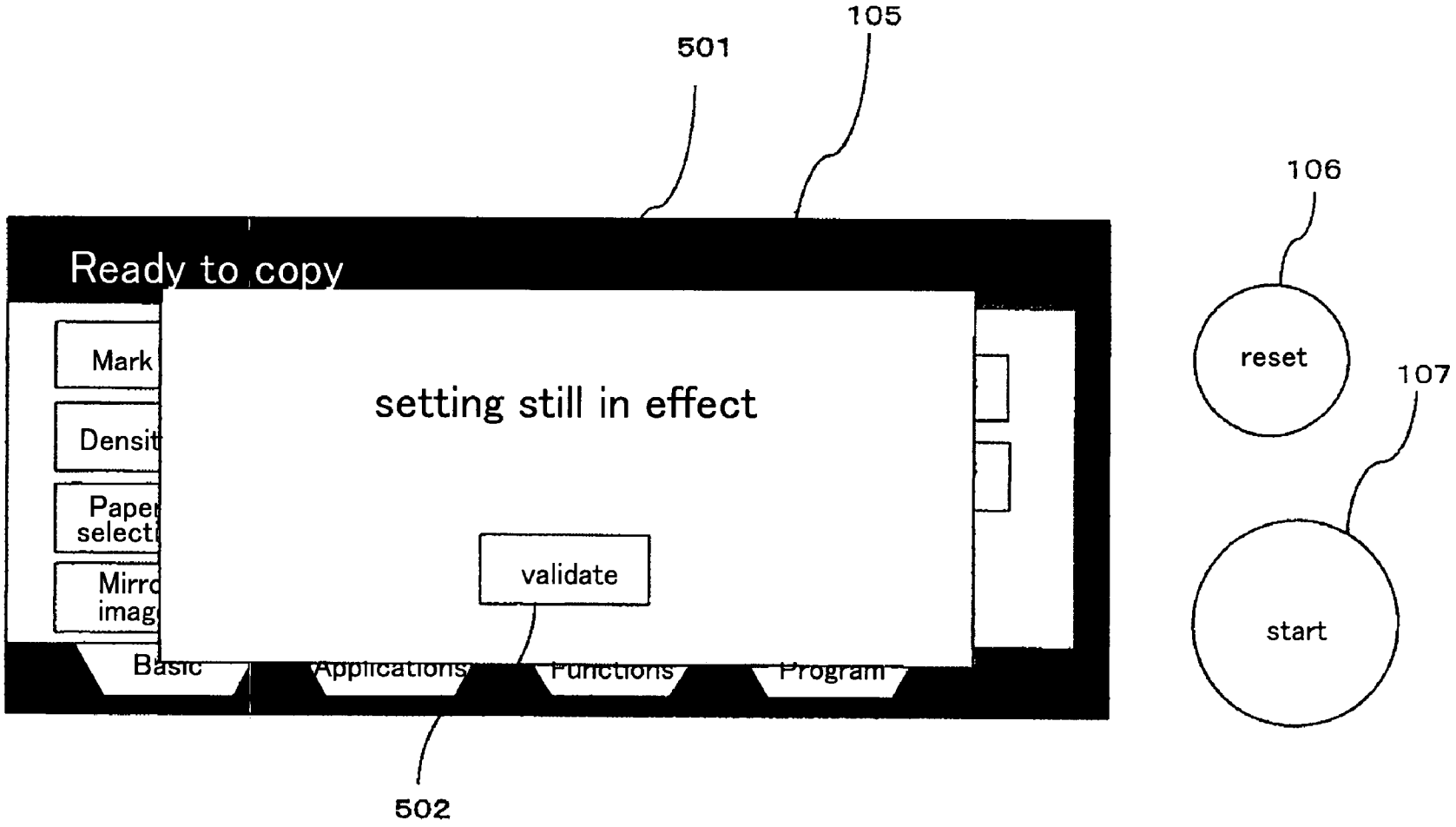
FIG. 5 is a schematic view of a control panel where a dialog box for warning has been displayed.

If not identical, the assessment means 205 reports to a warning means 207 the fact that it is not identical. When the fact that it is not identical is reported, the warning means 207 displays on the control panel 105 a warning dialog box 501, such as shown in FIG. 5 (FIG. 4, S403).

Figure 6:
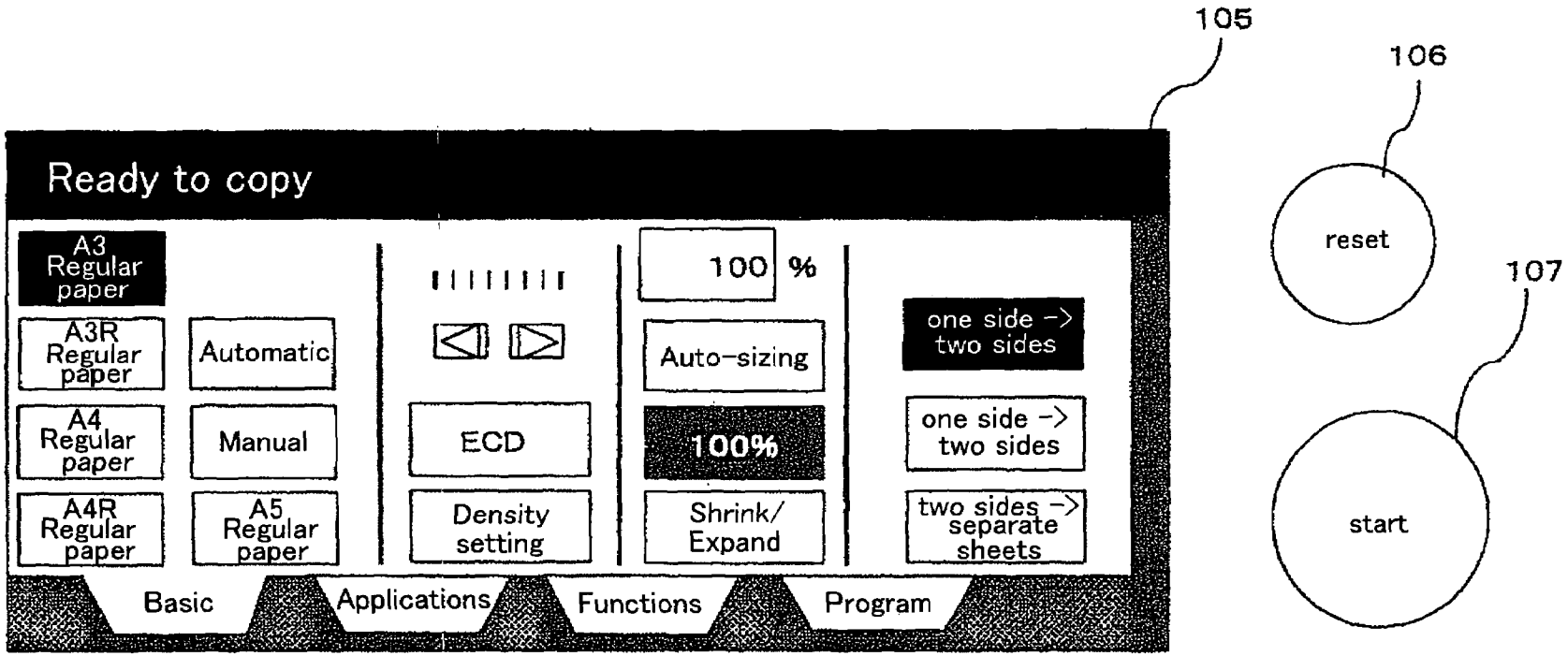
FIG. 6 is a schematic view of an operation unit.

When the user presses down a validation key 502 in the warning dialog box 501, the setting means 201 removes the warning dialog box 501 and displays on the control panel 105 a screen showing the copy mode registered with a current copy mode memorization means 202, such as shown in FIG. 6 (FIG. 4, S404 through S405). When this screen is displayed, the user validates the copy mode registered with the copy mode memorization means 202. If this mode registered with the copy mode memorization means 202 differs from the desired copy mode, the user presses down a key or the like displayed on the control panel 105 to redo the settings of the copy mode.

Once the desired copy mode is set, the user presses down a start key 107 to execute copy.

On the other hand, if a reset key 106 is pressed down while the warning dialog box 501 is being displayed, the setting means 201 overwrites the copy mode registered with the copy mode memorization means 202 with the default mode (FIG. 4, S406). Thus, when a user wants to copy in the default mode, pressing down the reset key 106 and then the start key 107 is all that is needed.

Figure 7:
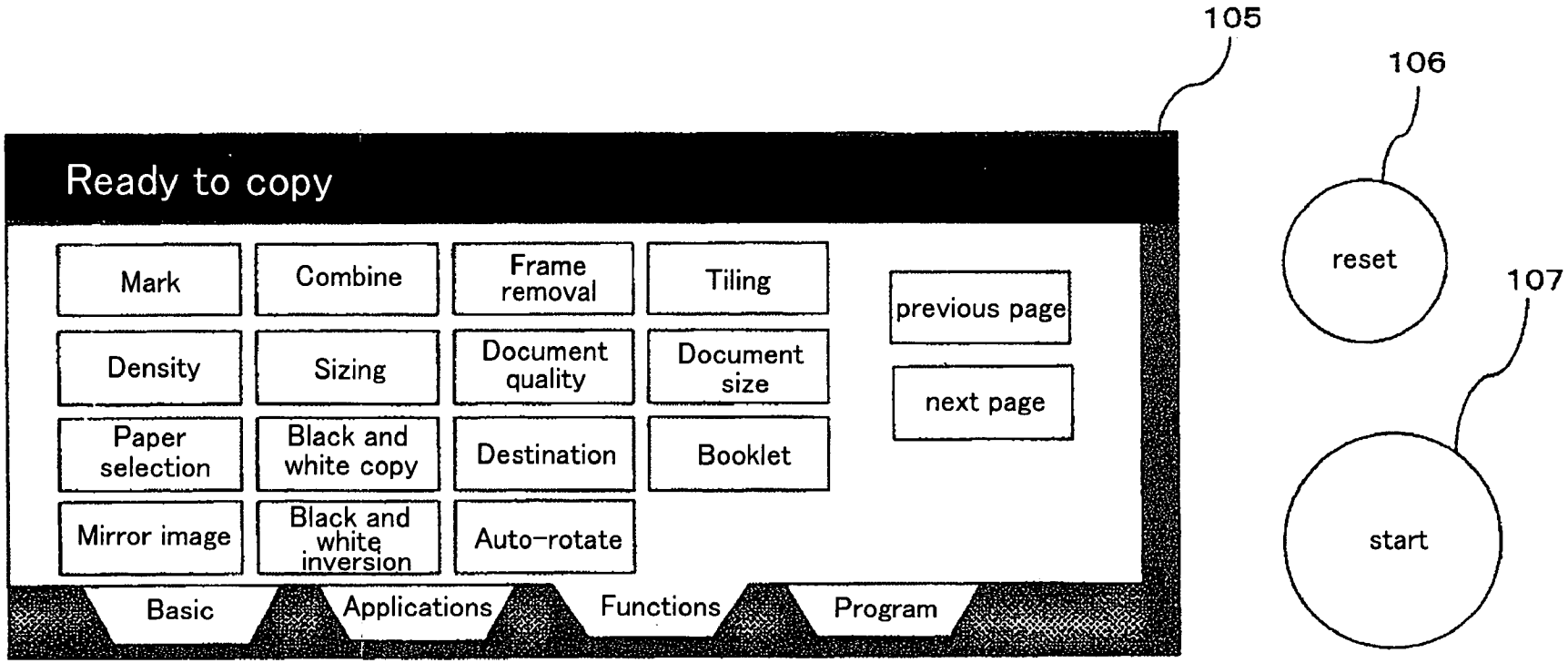
FIG. 7 is a schematic view of an operation unit.

In addition, if the assessment is identical in step 402, the assessment means 205 displays on the control panel 105 a screen for setting the copy mode, such as shown in FIG. 7.

What is claimed is:

1. An image forming device comprising:

setting means for setting a copy mode for a document;

control panel means for displaying said copy mode;

detection means for detecting whether or not a document has been placed on a document holder;

assessment means for assessing, when said detection means detects a document has been placed on the document holder, whether or not the copy mode set by said setting means is identical to the default mode; and warning means for issuing a warning if the assessed mode is not the default mode, said warning being a display of a warning dialog box on said control panel means.

2. The image forming device according to claim 1, further comprising said warning dialog box includes a validation key, wherein display of said warning dialog box configured to be removed by said setting means when said validation key is pressed and the copy mode remains the same as the assessed mode.

3. The image forming device according to claim 2, wherein said control panel means has at least one key that allows the user to determine the copy mode set by said setting means.

4. The image forming device according to claim 3, further comprising a reset button means for returning the copy mode to the default mode.

5. The image forming device according to claim 4, wherein said reset button means is pressed, said reset button removes display of said warning dialog box.

6. The image forming device according to claim 1, further comprising a reset button means for returning the copy mode to the default mode.

7. The image forming device according to claim 6, wherein said reset button means is pressed, said reset button removes display of said warning dialog box.

8. An image forming device comprising:

a setting device being configured to set a copy mode for a document;

a control panel being configured to display said copy mode;

a document holder being configured to hold documents;

a detection device being configured to detect a document being on a document holder;

an assessment device being configured to assess the copy mode set by said setting device when said detection device detects a document on said document holder being identical to or different from the default mode; and a warning device being configured to issue a warning when the assessed mode is not the default mode, said warning being a display of a warning dialog box on said control panel.

9. The image forming device according to claim 8, further comprising said warning dialog box includes a validation key, wherein display of said warning dialog box configured to be removed by said setting device when said validation key is pressed and the copy mode remains the same as the assessed mode.

10. The image forming device according to claim 9, wherein said control panel has at least one key that allows the user to determine the copy mode set by said setting device.

11. The image forming device according to claim 10, further comprising a reset button to return the copy mode to the default mode.

12. The image forming device according to claim 11, wherein said reset button is pressed, said reset button removes display of said warning dialog box.

13. The image forming device according to claim 8, further comprising a reset button to return the copy mode to the default mode.

14. The image forming device according to claim 13, wherein said reset button is pressed, said reset button removes display of said warning dialog box.

* * * * *